US007273302B2

(12) United States Patent
Bin

(10) Patent No.: US 7,273,302 B2
(45) Date of Patent: Sep. 25, 2007

(54) COLLAPSIBLE CHANDELIER

(76) Inventor: Chou Shih Bin, 3rd Floor, No. 107, Chung Cheng Road, Sec. 1, Shihlin, Taipei (TW)

( * ) Notice: Subject to any disclaimer, the term of this patent is extended or adjusted under 35 U.S.C. 154(b) by 70 days.

(21) Appl. No.: 11/211,976

(22) Filed: Aug. 25, 2005

(65) Prior Publication Data

US 2007/0047242 A1 Mar. 1, 2007

(51) Int. Cl.
*F21S 8/04* (2006.01)

(52) U.S. Cl. ..... 362/405; 362/388

(58) Field of Classification Search ..... 362/405, 362/547, 388, 406, 427, 429, 382
See application file for complete search history.

(56) References Cited

U.S. PATENT DOCUMENTS 2,680,841 A * 6/1954 Boutelle ..... 439/648
3,979,584 A 9/1976 Fossati
4,034,216 A 7/1977 Webster et al.
4,107,770 A 8/1978 Weber
4,477,866 A 10/1984 Goralnik
4,748,549 A * 5/1988 Scheer ..... 362/406
5,255,173 A 10/1993 Schonbek
5,873,652 A 2/1999 Bayer et al.
6,854,867 B2 2/2005 Mas Quiles et al.

* cited by examiner

*Primary Examiner*—Sharon Payne
(74) *Attorney, Agent, or Firm*—Zito

(57) ABSTRACT

A collapsible chandelier comprises a central body and a set of arms with light fixtures at their outer ends connected to said central body by a respective set of connection bosses. Said connection bosses comprise T-shaped pairs of intersecting sleeves; the horizontal section of which penetrates said central body and the vertical section of which houses an end of one of said arms. The ends of said arms are slotted to permit the passage of electrical wiring through said arms and bosses into said central body. When said arms are aligned and said bosses tightened, said arms project in a fixed manner radially away from said control body, and when said bosses are loosened, said arms may be partially rotated to collapse said chandelier for shipment or storage. A positioning notch and nub provide the means to properly orient and fix the arms into position when said boss is tightened.

6 Claims, 9 Drawing Sheets

COLLAPSIBLE CHANDELIER

FIELD OF THE INVENTION

The present invention relates to the field of chandelier light fixtures. More specifically, the present invention is a collapsible chandelier with uniquely connected arms which may be folded for shipping and storage.

BACKGROUND OF THE INVENTION

There are many types of chandeliers in the market. One of the considerations in the design of a chandelier is the trade off between ease of assembly and the shipping space the chandelier requires. Generally, the less assembly a given chandelier requires, the greater is its pre-installation shipping volume. For example, if a chandelier is knocked down to its elemental components, usually a central body, a set of arms, a set of bulb sockets and associated wiring and hanging apparatus, those components may be easily nested among each other to minimize the shipping volume. However, the shipping benefit tends to be offset by the relative complexity of the assembly required by a consumer. On the other hand, a fully assembled, ready-for-installation version of such a chandelier utilizes valuable space during shipping, adding to the cost of the product.

Various inventive concepts have been promulgated over the years aiming at a middle ground in the assembly-vs.-shipping volume trade-off. For example, Schonbek in U.S. Pat. No. 5,255,173 discloses a chandelier with removable arms which may be fixed into the correct position on a mounting plate of the central column during lamp assembly. It is possible to ship the central column separate from the arms, thus enabling the shipper to nest the arms with the column in an economical manner. However, in this disclosure, although the chandelier's arms are separable from the central column, the electrical wiring is not able to be disconnected at the same mechanical junction. This requires the end-user to have at least rudimentary mechanical and electrical knowhow to complete assembly of the lamp.

In U.S. Pat. No. 5,873,562, Bayer et al. discloses a totally separable-arm concept wherein the arm is shipped completely detached from the mounting plate. In this invention, a socket and plug electrical connection mechanism is integrated with the arm-to-mounting plate connecting mechanism. However, this type of electrical connection and the mechanical attachment means of the arm to the mounting plate are cumbersome and make the lamp relative expensive to produce.

A better version of the separable-arm concept is disclosed in U.S. Pat. No. 6,854,867 by Más Quiles et al. In that disclosure, the column-to-arm connection is based on a simple mechanical coupling with flat electrical contacts, held together within the coupling. While this design is more economical, it is still a relatively expensive attachment mechanisms and limits the flexibility of the design of the lamp.

The above inventions, although being relatively expensive, do permit a breakdown of the chandelier for shipping. However, all the designs require loose-part assembly by the end user. Stepping back in history, Goralnik in U.S. Pat. No. 4,477,866 first discloses a chandelier with non-detachable, rotatable arms. In one embodiment of the invention, the arms are rotatably engaged with the mounting plate such that the arms are positioned generally parallel to each other for shipping and then rotated into a snap-locked, fixed position during assembly by the end user. The idea of having the arms fold without being detached is beneficial for several reasons. First, there is less likelihood that the correct number of arms will not ship with the lamp. Second, there is less likelihood of end-user error or breakage when it comes to assembly. Third, simply folding the arms into place is generally preferable to having to both attach and position the arms. Finally, the folding design avoids the expense of the integrated mechanical/electrical connection.

However, the nature of Goralnik's pivot-facilitating mechanism is fairly rudimentary. The snap-lock scheme is good for a one-time-only use of the inventive idea, after which, the end-user would find difficulty repeating. The design is also generally labor and material intensive and prone to failure of the arm to slide plate connection.

Other designs observed in the marketplace provide for an arm folding mechanism which utilizes a spring washer or similar feature at the arm-to-connection box. These designs require that the arms pass vertically through the top of the connection box, thus limiting the design options for the chandelier.

Therefore a more versatile, more reliable and less expensive mechanism for collapsing a chandelier for shipping without disconnecting the arms and electrical components is desired.

SUMMARY OF THE INVENTION

A collapsible chandelier is disclosed having a conventional central body and radial arms, but with a novel form of connection of the arms to the body. The arms are rotatably connected to the body through a connection boss which at the boss arm connection point allows the arm to swivel within the boss.

In an exemplary embodiment, the connection boss comprises a horizontally configured T-shaped pair of sleeves. The horizontal oriented sleeve is threaded on it outer end and penetrates the central body. The vertical oriented sleeve accommodates the inner end of an arm. There is a hole at the intersection of the pair of sleeves and a slot in the inner end of the arm. When the end of the arm is positioned correctly within the vertical sleeve, an electrical cord may pass from a light fixture at the outer end of the arm, through the arm, through the slot in the inner end of the arm, through the hole at the intersection of the pair of sleeves, into the horizontal sleeve and through the horizontal sleeve into the central body. With the cord in place, the inner end of the arm is able to rotate within the connection boss.

A cap permits tightening of the boss-arm junction and a positioning nub and notch at each junction assures fixed alignment for the arms with the cap tightened. When the cap is loosened, the nub will disengage from its positioning notch and the end of the arm will rotate within the vertical sleeve of the boss, allowing the arms to swivel to one side or the other. This permits nesting of the arms into clusters, for example, two clusters, one each on opposite sides of the central body, and reduces the volume of the chandelier for shipping and storage.

The novel design of the boss permits the lamp to be knocked down for delivery to an end-user and facilitates assembly of the lamp with little mechanical skill. The economical design also permits a wider variety of general designs of collapsible chandeliers than is available on the market at present.

BRIEF DESCRIPTION OF THE DRAWINGS

Exemplary embodiments of the invention are discussed hereinafter in reference to the drawings, in which.

DETAILED DESCRIPTION OF PREFERRED EXEMPLARY EMBODIMENTS

Figure 1B:
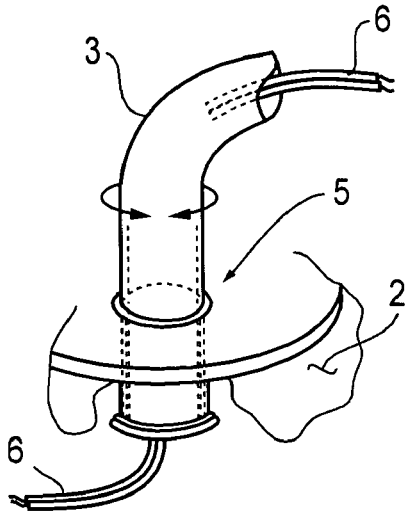
FIG. 1B PRIOR ART
FIG. 1B is a detail of the prior art arm to body connection. This style of arm to body connection limits the variability of the design of the lamp.
Figure 1A:
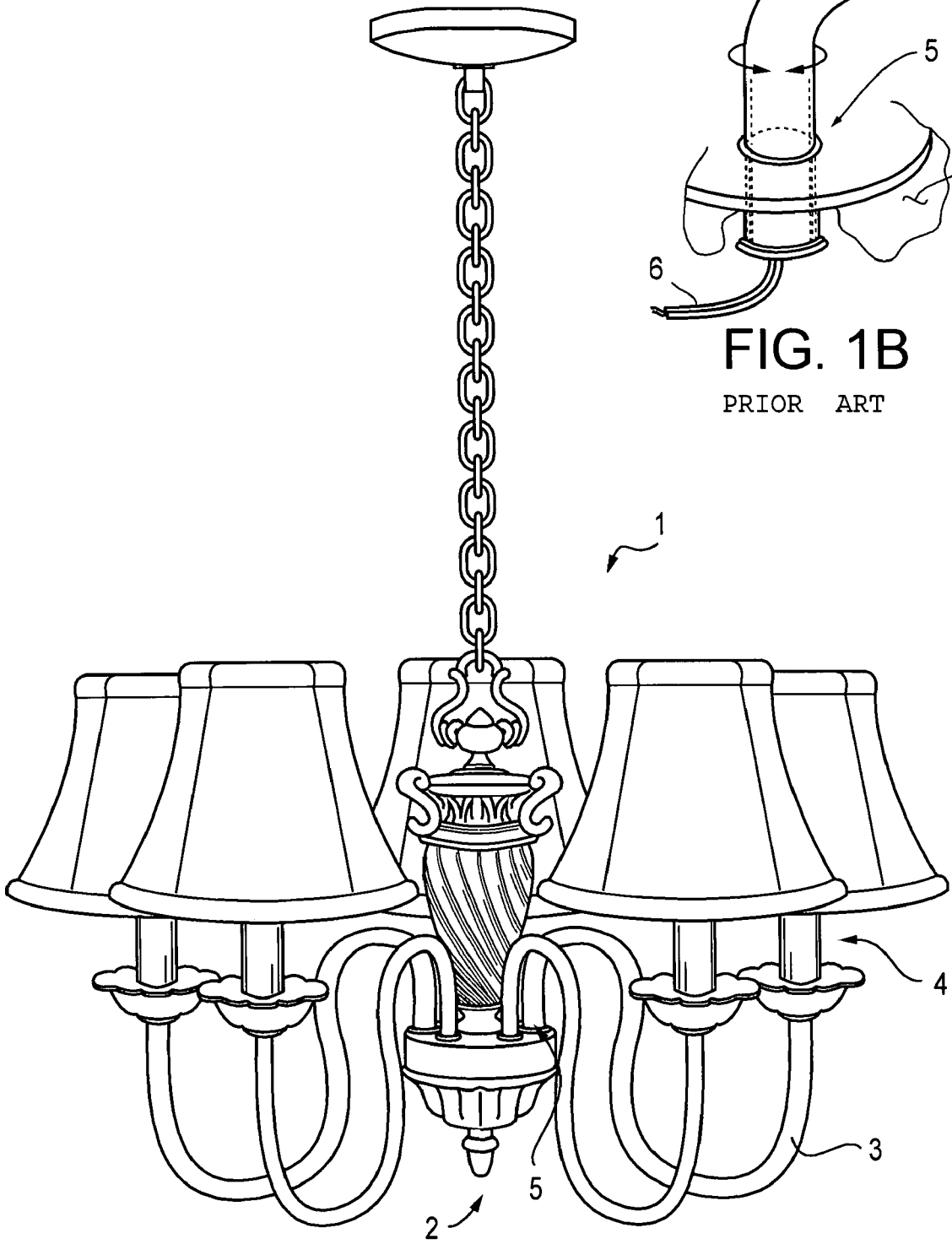
FIG. 1A PRIOR ART
FIG. 1A is a view of a folding chandelier of the prior art with arms which penetrate the top of a central body. The arms swivel from side to side, allowing them to be folded so as to minimize the volume of the chandelier for shipping and storage.

As is generally known in the art, an example of which is shown in FIG. 1A, a collapsible chandelier 1 comprises a central body 2 and a set of arms 3 with electric light fixtures 4 at their outer ends. As can be observed in FIG. 1A, the central body comprises a decorative housing having a vertical axis along which it hangs. The central body serves as the structural framework of the lamp, including structural support for the arms. The arms attach to the lamp, generally in a circular or other radially centric shape about the vertical axis of the central body. The points of attachment of the arms vary in design, but as is shown in FIG. 1B, a typical point of attachment involves a swivel-type socket connection 5. In this type connection, the arms of the lamp are free to be rotated about the vertical axis of the connection, parallel to the axis of the central body, to permit folding the lamp into a smaller configuration for packaging and shipment. However, as has been mentioned above, this type of junction limits the design options on a collapsible lamp.

The central body also houses the electric wiring 6 which generally comes into the lamp from above and is distributed to the arms via some type of distribution system. In the lamp shown in FIG. 1A, the wire is distributed to the arms through (i.e., internal to) the socket connection 5 of the arms 3 to the body 2. The arms are hollow and the wire passes to them from the central body and through them to the light bulb sockets.

Figure 2:
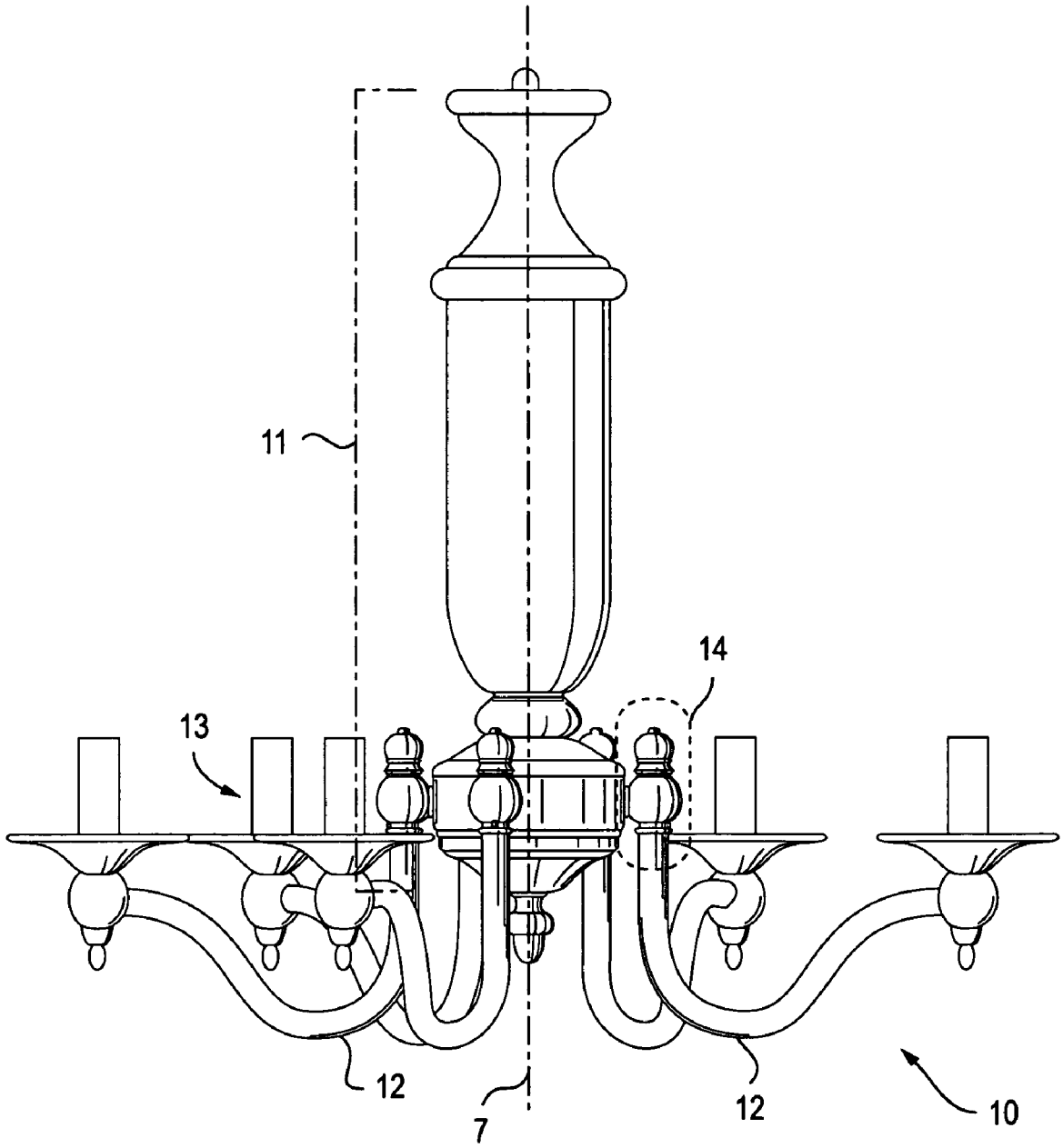
FIG. 2 is a view of the collapsible chandelier of the present invention in its fully assembled configuration. This view introduces the inventive connection boss for attaching the arms to the central body.

As shown in FIG. 2, the collapsible chandelier 10 of the present invention also comprises a central body 11 and a set of arms 12 with electric light fixtures 13 at their outer ends. Arms 12 are structurally connected to body 11 in a radially concentric pattern around a vertical body axis 7 of the chandelier via a series of decorative, yet functional connection bosses 14.

Figure 3:
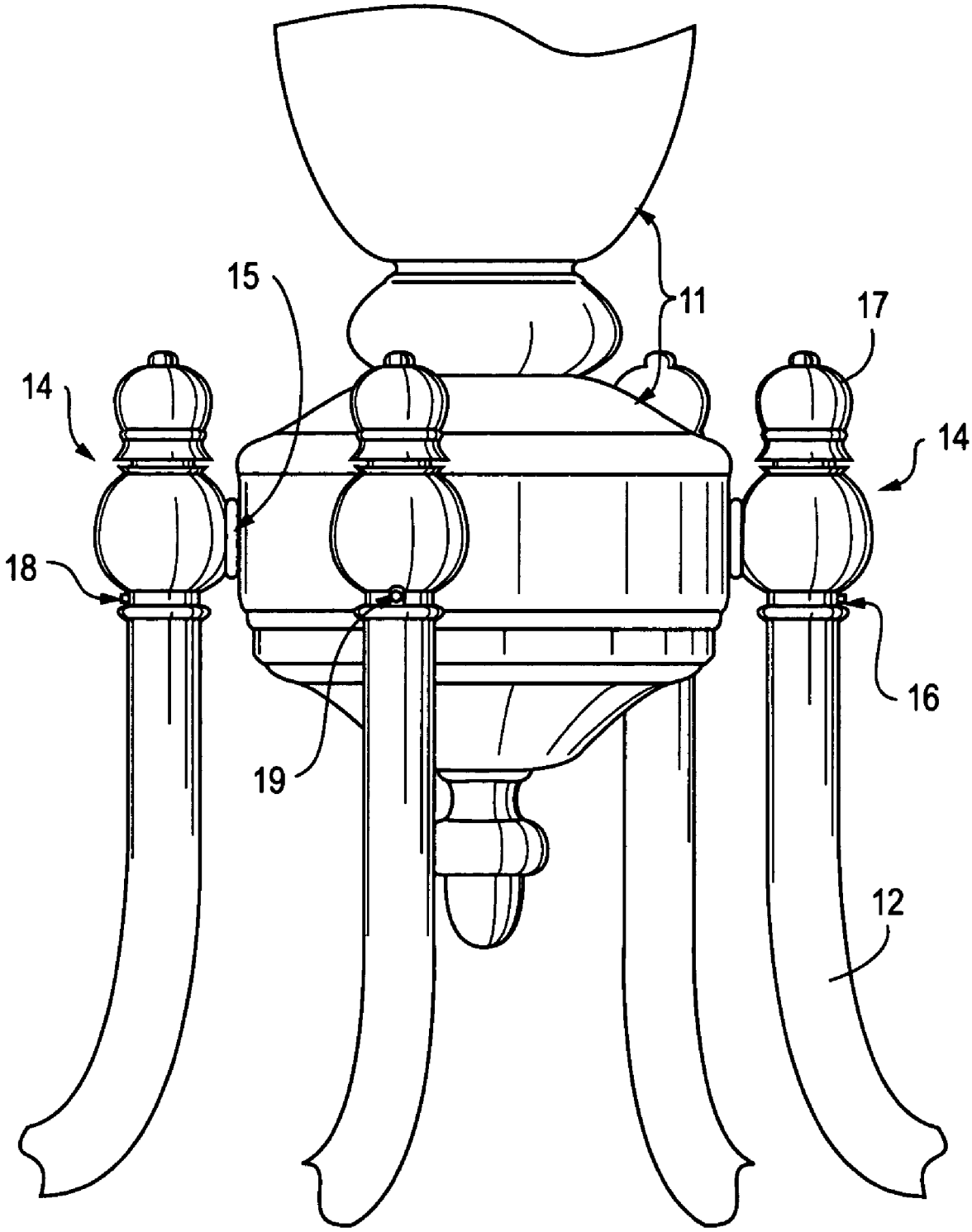
FIG. 3 is a closeup view of the chandelier of FIG. 2 showing the details of the arm to body connection boss 14. In this view the boss is tightened with the positioning nub 18 engaged with the positioning notch 19.
Figure 4:
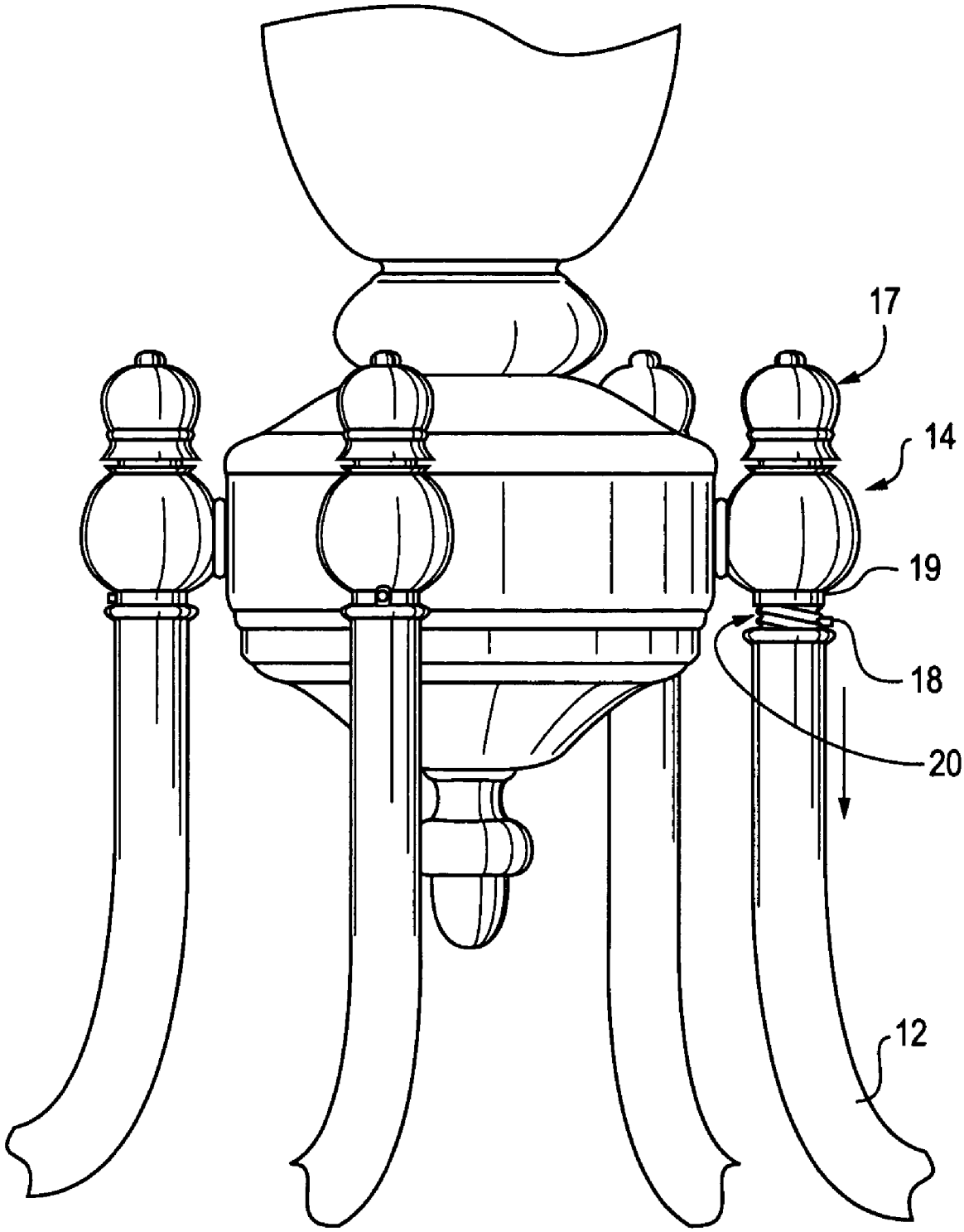
FIG. 4 is a closeup view of the chandelier showing the details of a loosened connection boss 14. In this view the positioning nub 18 is not engaged with the positioning notch 19 and the arm is free to rotate.
Figure 5:
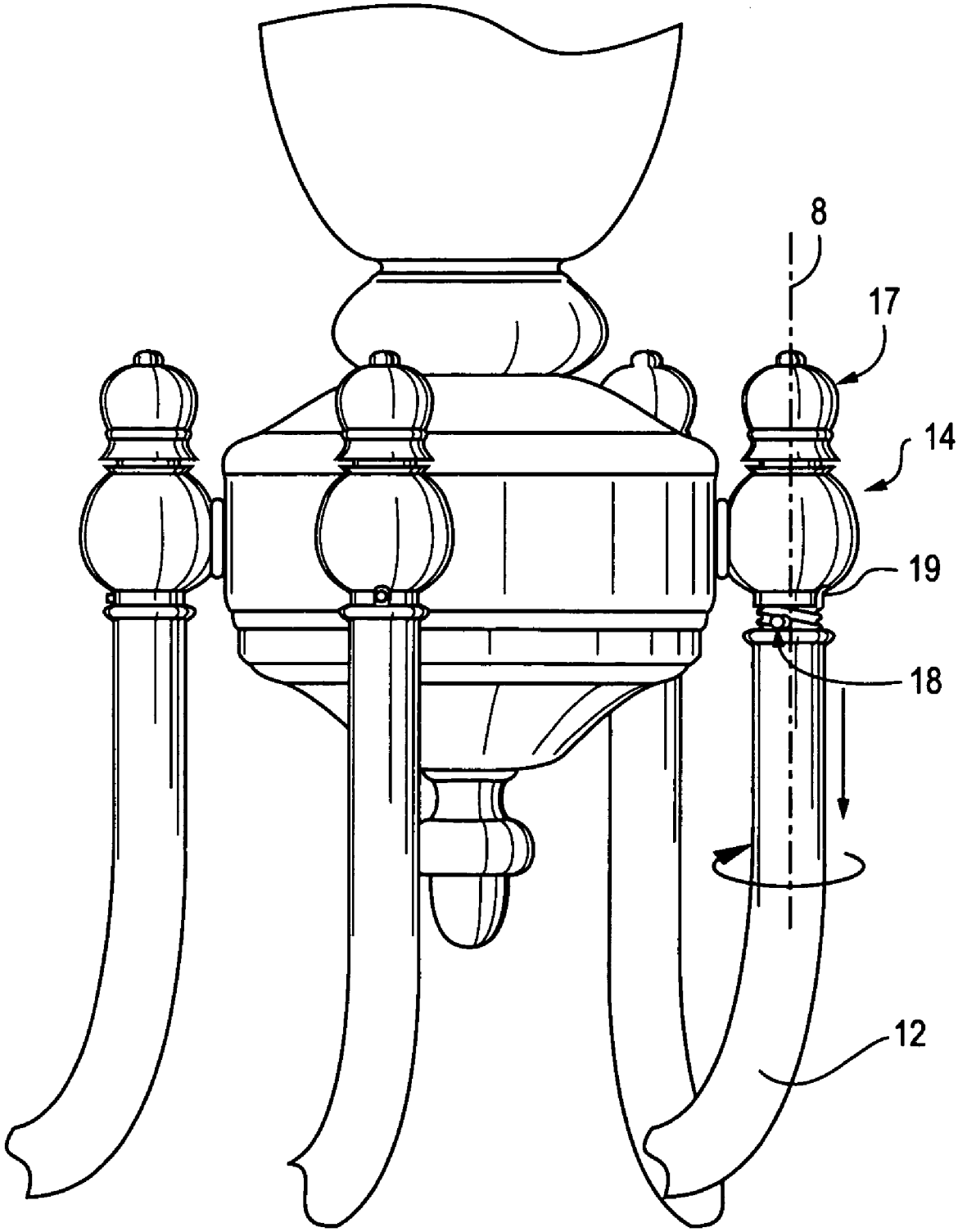
FIG. 5 is a closeup view of the loosened connection boss 14 with the arm swiveled. The swivel is indicated by noting the misalignment of the positioning nub 18 with respect to the positioning notch 19.
Figure 6:
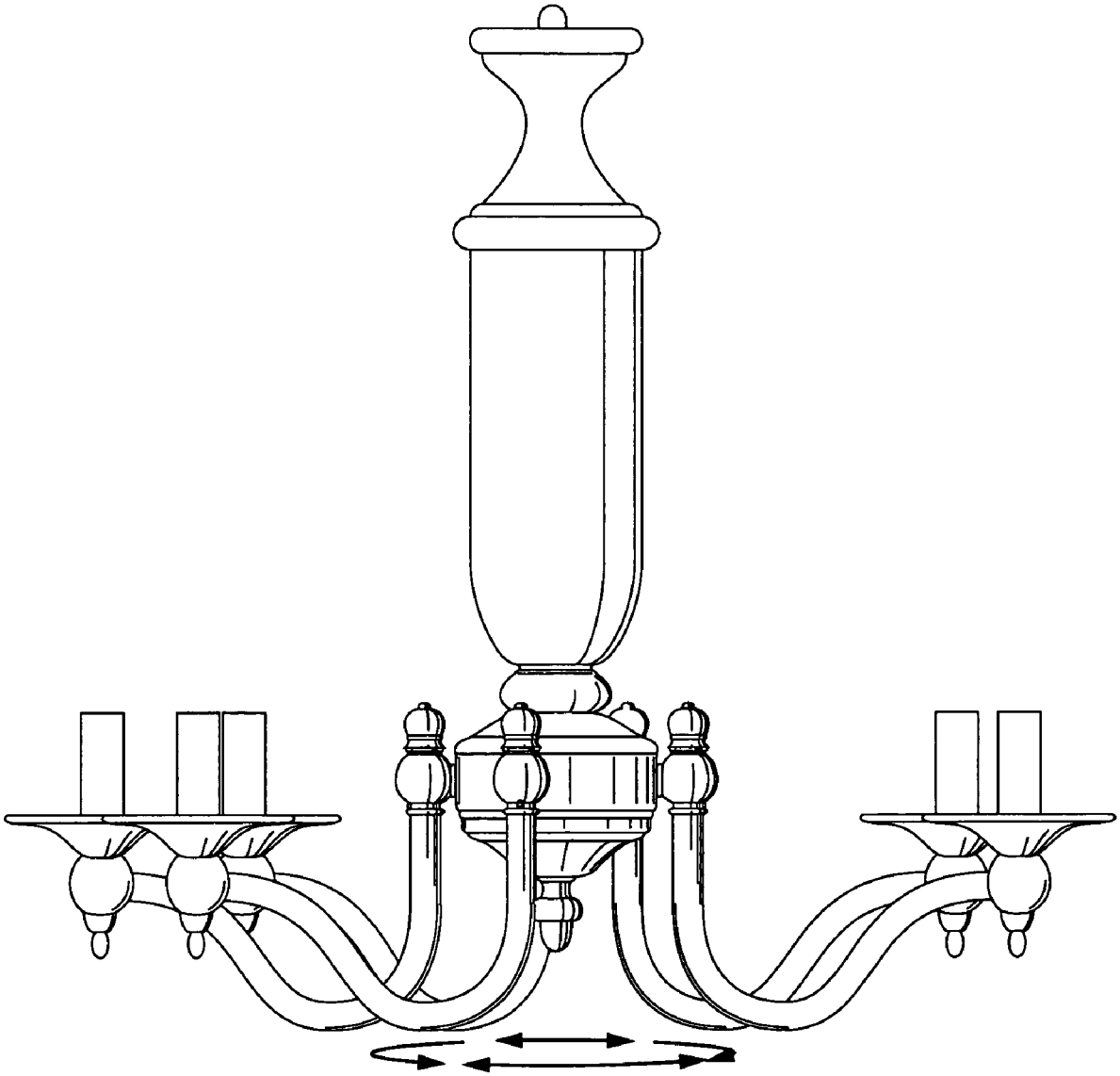
FIG. 6 is a perspective view of the chandelier with the connection bosses loosened and the arms swiveled, folding them into two nested groups. In this configuration the chandelier takes up less volume for shipping or storage.

Central to the inventive concept, and as shown in FIG. 3, connection bosses 14 penetrate the vertical outside surface of central body 11 at penetrations 15. Arms 12 enter the bottom of boss 14 at lower sleeve ends 16 and extend through the bosses and into caps 17. A positioning nub 18 on each arm fits into a positioning notch 19 on each boss 14. As shown in FIG. 4, arms 12 have a connection end 20 which passes through boss 14 and threads into cap 17. When cap 17 is loosened, the connection end 20 of arm 12 is able to return partially back through the boss until positioning nub 18 disengages from positioning notch 19. In this manner, as shown in FIG. 5, arms 12 may be rotated about vertical boss axis 8 of the decorative connection boss, allowing them to swivel and nest together to reduce the effective volume of the lamp for storage and shipping. FIG. 6 indicates a view of the chandelier with three arms folded together on one side and two arms folded together on the other side.

Figure 7:
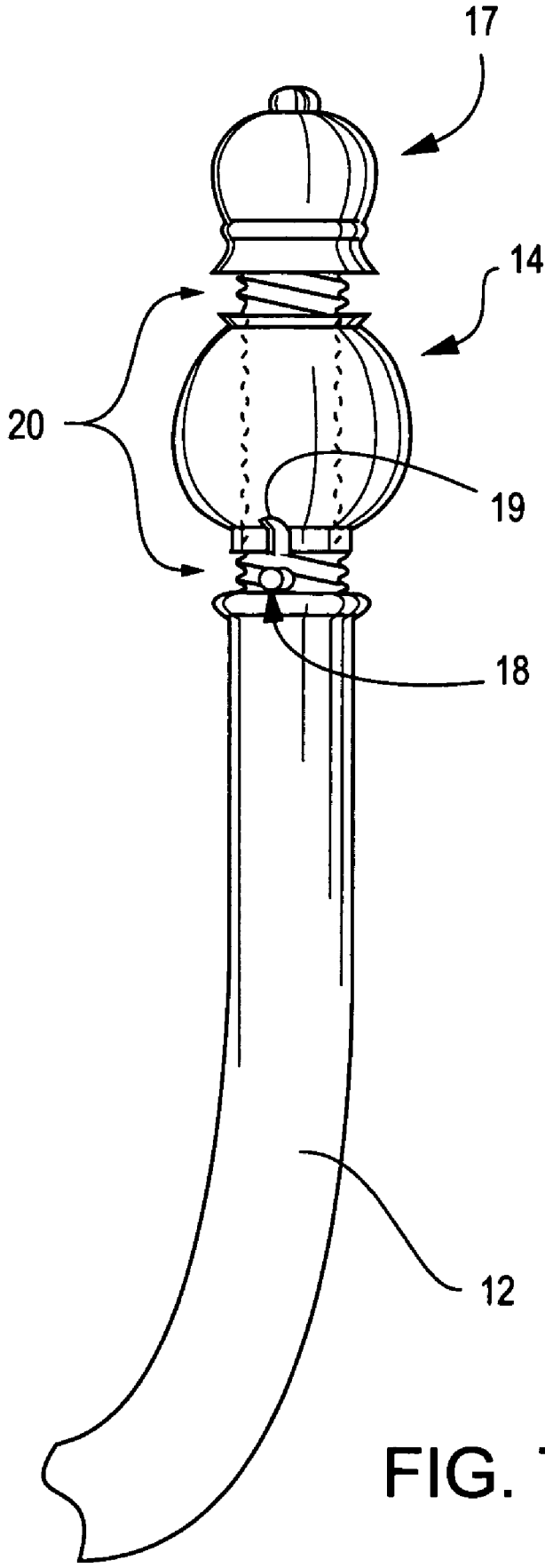
FIG. 7 is an exploded view of the connection boss with the connection end of the arm inserted and the cap removed.

FIG. 7 shows an exploded view of connection boss 14 with connection end 20 of arm 12 installed in a rotatable position within the boss, i.e., with positioning nub 18 disengaged from positioning notch 19. Cap 17 is shown removed from the upper end of connection end 20 for clarity. A similar view is also seen if FIG. 4.

Figure 8:
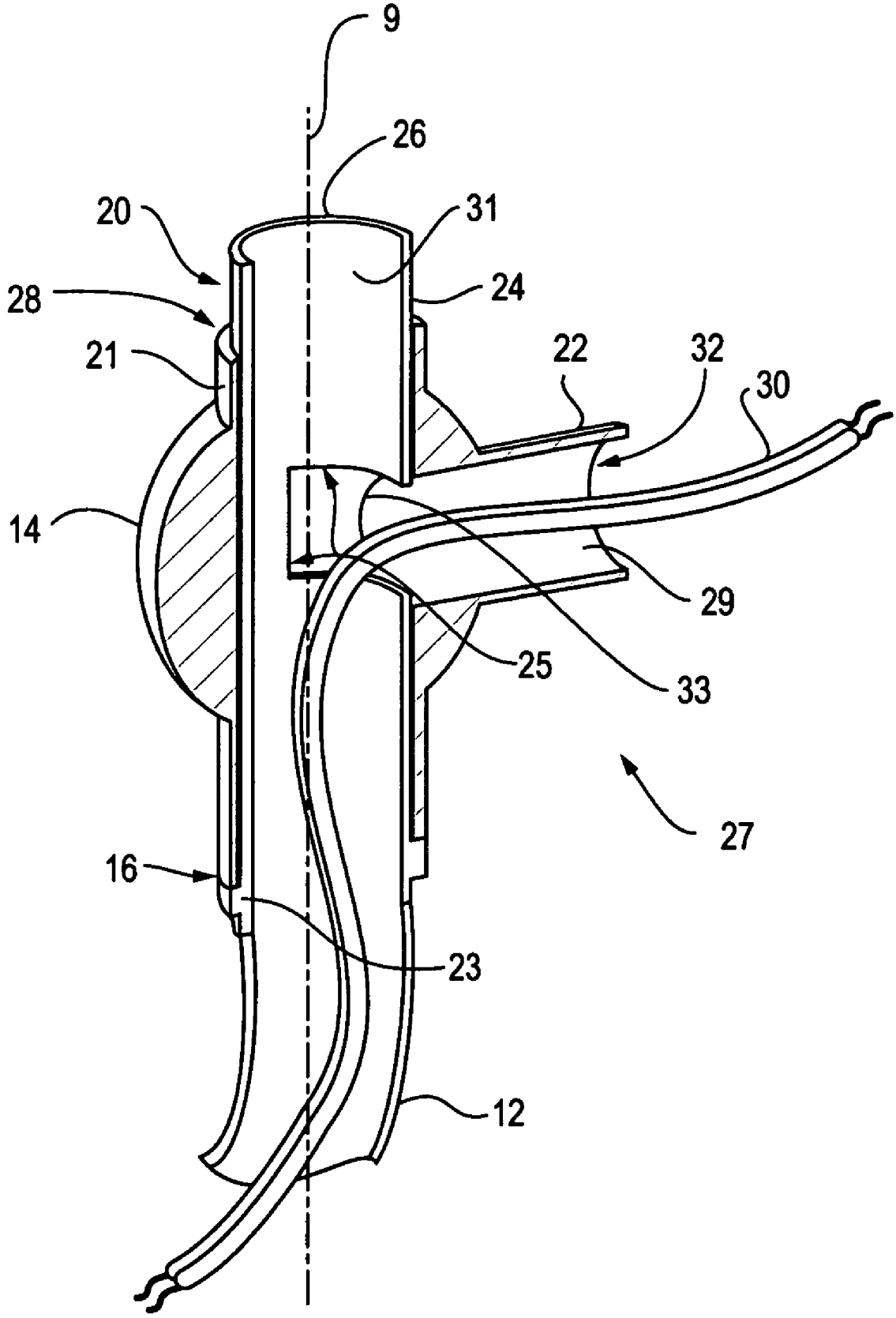
FIG. 8 is a cut-away view of the boss-arm junction showing the slot in the connection end of the arm aligned with the horizontal sleeve of the boss, facilitating the passage of an electrical wire through the rotatable junction.

FIG. 8 is a cut-away view of the interconnection of boss 14 and connection end 20 of arm 12. This is referred to as boss-arm junction 27. Cap 17 has been removed from the drawing for clarity.

Connection boss 14 comprises a vertical sleeve 21 having a vertical sleeve axis 9 intersecting a horizontal sleeve 22 at roughly the mid-section of vertical sleeve 21. This is known as boss sleeve intersection point 33. Horizontal sleeve 22, has an outer horizontal sleeve end 32 which passes through central body 11 and which is threaded externally (see FIG. 9B). A threaded fastener (not shown) is threaded onto outer horizontal sleeve end 32 from inside central body 11 securing boss 14 to the central body. With positioning nub 18 aligned so as to slide into positioning notch 19 as shown in FIG. 3, connection end 20 will pass into and through vertical sleeve 21 as shown in FIG. 8 until a flange 23 engages the lower sleeve end 16 of vertical sleeve 21.

Connection end 20 comprises a hollow tube portion 24 of arm 12 which is threaded from its upper tube end 26 to flange 23. Alternatively, threading of end 20 may only occur proximate to end 26 without departing from the scope of the invention. A horizontal slot 25 runs partially around hollow tube portion 24, positioned generally mid way between end 26 and flange 23 (see FIG. 9A). This is known as the hollow tube midpoint.

To assemble boss-arm junction 27, hollow tube portion 24 is slid into the lower sleeve end 16 of boss 14 until it projects through upper sleeve end 28. The length of the projection of upper tube end 26 from upper sleeve end 28 depends on the relative positioning of nub 18 and notch 19. With the nub and notch aligned, hollow tube portion 24 passes through boss 14 until lower sleeve end 16 at the bottom of the boss engages flange 23. This arrangement is shown in FIG. 3. However, with the nub and notch misaligned, hollow tube portion 24 only passes through boss 14 until nub 18 engages lower sleeve end 16 of the boss (rather than notch 19), effectively preventing the joint from locking and allowing arms 12 to be rotated to collapse the chandelier. This arrangement is shown in FIG. 5.

To proceed with assembly of the boss-arm junction, nub 18 is aligned with notch 19, and hollow tube portion 24 is passed through boss 14 until flange 23 engages lower sleeve end 16. Arm 12 is then slid into vertical sleeve 21 until slot 25 at the hollow tube midpoint is aligned with boss sleeve intersection point 33 (see FIG. 8). Next, an electric power cord 30 is passed from light socket 13, into hollow arm 12, up to and through interior vertical sleeve area 31 of hollow tube portion 24, out of the hollow tube portion, through slot 25, into horizontal sleeve interior area 29 and out through outer horizontal sleeve end 32 of horizontal sleeve 22. Cap 17 is threaded onto upper tube end 26 of hollow tube portion 24, tightening the engagement of lower sleeve end 16 and flange 23, and with nub 18 aligned and engaged with notch 19. The fully assembled configuration is shown in FIG. 3.

In the assembled configuration described above, although cord 30 acts as an impediment to the separation of the boss-arm junction and to rotation of upper tube end 26 of arm 12 within boss 14, it is possible to loosen cap 17 sufficiently to back hollow tube portion 24 partially out of boss 14, thus disengaging nub 18 and notch 19. In this loosened configuration, shown generally in FIG. 5, hollow tube portion 24 is then able to be rotated within the boss, to permit folding of arms 12 together, nesting them generally into two groups of arms arranged generally opposite to each other relative to the central body to lessen the volume of the chandelier for shipping. This exemplary arrangement is shown in FIG. 6.

Figure 9A:
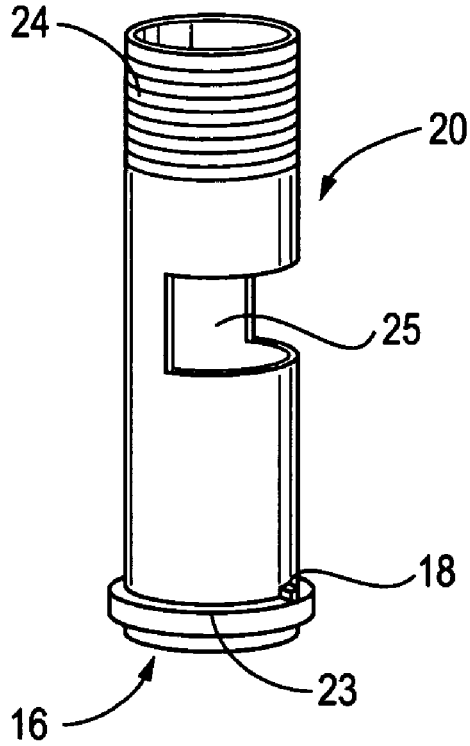
FIG. 9A is a detail view of the connection end of an arm. The arm is not shown connected to its lower end, indicating that a wide variety of arms may be employed with this concept.
Figure 9B:
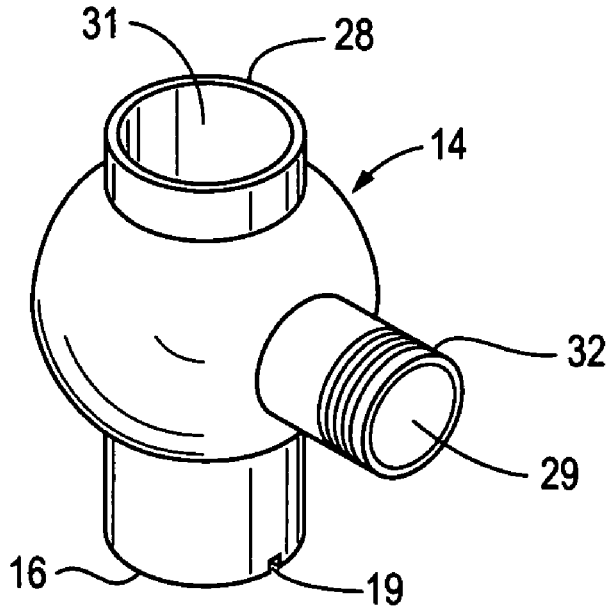
FIG. 9B is a detail view of the connection boss 14 by itself.

FIGS. 9A and 9B present separate perspective views of connection end 20 and boss 14. In FIG. 9A, connection end 20 has been shown truncated and not connected to its arm. This depiction is meant to indicate that differing arrangements of arms may be connected to the lower sleeve end 16 of connection end 20 without deviating from the inventive idea. FIG. 9B indicates positioning nub 18 in its preferred location proximate to the upper flange side of flange 23.

In the above embodiment of the collapsible chandelier, the boss has been shown as a vertical sleeve with an ornamental cap and as having a decorative ball-shaped middle section which accepts a threaded end from its bottom opening. However, the boss including the cap may be of any decorative design and the threaded end may be accepted from any other orientation without departing from the scope of the invention.

The remainder of the collapsible chandelier is designed and assembled as is generally known in the art. However, with the inventive connection boss and the rotatable boss-arm junction, the chandelier is able to be designed in a greater variety of ways and still is able to be folded compactly for shipping and storage with a minimum of effort or skill required to assemble the finished product.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. A collapsible chandelier, comprising:

a central body having a vertical body axis and a vertical outside surface;

a plurality of arms having an inner connection end and an outer fixture end and which project generally away from said vertical axis;

a plurality of electric light fixtures respectively fixed at said fixture ends; and a plurality of connection bosses having a vertical boss axis and each of said bosses operatively connecting said central body and a respective one of said inner connection ends to form respective boss-arm junctions;

wherein said connection boss comprises:

a vertical sleeve having a vertical sleeve axis coincident with said vertical boss axis and having an upper sleeve end and a lower sleeve end, and having an interior vertical sleeve area;

a horizontal sleeve intersecting at a right angle with said vertical sleeve at a boss sleeve intersection point located between said upper and lower sleeve ends and having an inner horizontal sleeve end and an outer horizontal sleeve end and having a horizontal sleeve interior area and a horizontal sleeve exterior surface having sleeve threads on said horizontal sleeve exterior surface extending from said outer horizontal sleeve end along said horizontal sleeve; and a positioning notch located at said lower sleeve end.

2. The collapsible chandelier of claim 1, wherein said connection end comprises:

a hollow tube portion having a vertical tube axis and having an upper tube end and a lower tube end, an interior tube area and an exterior tube surface and having tube threads on said exterior surface extending from said upper tube end along said hollow tube portion;

a slot in said hollow tube portion located at a hollow tube midpoint between said upper and lower tube ends;

a flange projecting perpendicularly away from said exterior tube surface proximate to said lower tube end and having an upper flange side facing away from said lower tube end; and a positioning nub positioned on said exterior tube surface proximate to said upper flange side and oriented so as to engage said positioning notch when said lower sleeve end engages said upper flange side and said hollow tube midpoint aligns with said boss sleeve intersection point.

3. The collapsible chandelier of claim 2 wherein said boss-arm junction comprises an operative interconnection of said connection end inside said vertical sleeve aligning said vertical tube axis with said vertical sleeve axis whereby said slot is oriented proximate to said boss sleeve intersection point such that a passageway exists from said lower tube end, along said interior tube area, through said slot, into said horizontal sleeve interior area and through said outer horizontal sleeve end into said central body.

4. The collapsible chandelier of claim 3, further comprising caps designed to thread onto said tube threads until said caps engage said upper sleeve ends.

5. The collapsible chandelier of claim 4, further comprising electrical wiring passing through said central body, said passageway, and said arms to connect to said light fixtures.

6. The collapsible chandelier of claim 5, wherein said operative interconnection:

permits tightening of said boss-arm junction by tightening said cap to engage said cap with said upper sleeve end and with said positioning nub engaging said positioning notch to fix said arms in relation to said central body, and permits loosening of said boss-arm junction by loosening said cap to disengage said cap from said upper sleeve end and to disengage said positioning nub from said positioning notch to enable rotation of said arms about said vertical boss axis for the collapsing of said chandelier.

* * * * *